US008961135B2

(12) United States Patent
Beeck et al.

(10) Patent No.: US 8,961,135 B2
(45) Date of Patent: Feb. 24, 2015

(54) MATEFACE GAP CONFIGURATION FOR GAS TURBINE ENGINE

(75) Inventors: Alexander R. Beeck, Orlando, FL (US); Shantanu P. Mhetras, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 857 days.

(21) Appl. No.: 13/171,691

(22) Filed: Jun. 29, 2011

(65) Prior Publication Data

US 2013/0004315 A1 Jan. 3, 2013

(51) Int. Cl.
*F01D 5/22* (2006.01)
*F01D 11/00* (2006.01)
*F01D 5/14* (2006.01)

(52) U.S. Cl.
CPC *F01D 5/143* (2013.01); *F01D 5/22* (2013.01); *F01D 11/003* (2013.01)
USPC ..... 416/97 R; 416/193 A

(58) Field of Classification Search
CPC ..... F01D 11/006; F01D 5/143; F01D 5/147; F01D 5/186; F05D 2240/80; F05D 2240/81
USPC ..... 415/115, 139, 914; 416/193 A, 97 R, 416/97 A
See application file for complete search history.

(56) References Cited

U.S. PATENT DOCUMENTS 2,955,799 A * 10/1960 Oickle, Jr. ..... 416/140
4,623,298 A 11/1986 Hallinger et al.
4,878,811 A 11/1989 Jorgensen
4,948,338 A * 8/1990 Wickerson ..... 416/92
5,154,581 A * 10/1992 Borufka et al. ..... 416/190
5,382,135 A 1/1995 Green
6,261,053 B1 * 7/2001 Anderson et al. ..... 415/115
6,558,121 B2 * 5/2003 Zhu et al. ..... 416/193 A
6,672,832 B2 * 1/2004 Leeke et al. ..... 415/191
7,134,842 B2 11/2006 Tam et al.
7,708,528 B2 5/2010 Couch et al.
2007/0258810 A1 11/2007 Aotsuka et al.
2010/0158696 A1 6/2010 Pandey et al.
2011/0014056 A1 * 1/2011 Guimbard et al. ..... 416/223 A
2012/0051921 A1 * 3/2012 Reno ..... 416/219 R

FOREIGN PATENT DOCUMENTS

JP 56104101 A * 8/1981
JP 60002202 A * 2/1985

OTHER PUBLICATIONS

Ching-Pang Lee et al.; U.S. Appl. No. 12/723,880, filed Mar. 15, 2010; entitled "Airfoil Having Built-up Surface With Embedded Cooling Passage".

* cited by examiner

*Primary Examiner* — Edward Look
*Assistant Examiner* — Jesse Prager

(57) ABSTRACT

In a gas turbine engine, adjoining pairs of airfoil structures include airfoils mounted to respective platforms. The platforms have side edges defining matefaces that form a mateface gap extending from an upstream edge of the platforms to a downstream edge of the platforms. A flow field of working gas adjacent to endwalls of the platform comprises streamlines extending generally transverse to the axial direction from a first airfoil toward an adjacent second airfoil. To achieve improved aerodynamic performance, the mateface gap has portions oriented transverse to the streamlines and oriented aligned with the streamlines. A step in elevation of the side edges at the transverse portion can include injected cooling flow in a direction that enhances attachment of the flow at a downstream side.

18 Claims, 6 Drawing Sheets

MATEFACE GAP CONFIGURATION FOR GAS TURBINE ENGINE

FIELD OF THE INVENTION

The present invention relates generally to gas turbine engines and, more particularly, to mateface gap configurations for airfoil structures in turbine engines.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades forms a stage in the turbine section.

Advanced gas turbines with high performance requirements attempt to reduce the aerodynamic losses as much as possible in the turbine section. This in turn results in improvement of the overall thermal efficiency and power output of the engine. One possible way to reduce aerodynamic losses is to incorporate endwall contouring on the blade and vane shrouds in the turbine section. Endwall contouring when optimized can result in a significant reduction in secondary flow vortices which may contribute to losses in the turbine stage.

SUMMARY OF THE INVENTION

In accordance with one aspect, the present disclosure provides an assembly of flow directing members that may be located in an axial flow path for a working gas in a turbine engine. A plurality of airfoils is mounted to respective platforms. Each airfoil includes a span dimension extending radially outwardly through the flow path and a chord dimension generally extending in an axial direction of the flow path. The platforms comprise endwalls facing the flow path and defining a circumferential boundary of the flow path. The platforms comprise an adjoining pair of platforms having side edges defining matefaces adjoining each other and forming a mateface gap extending from an upstream edge of the platforms to a downstream edge of the platforms. The working gas defines a flow field adjacent to the endwalls comprising streamlines extending generally transverse to the axial direction from a first airfoil toward an adjacent second airfoil. The mateface gap comprises a transverse portion that traverses a direction of the streamlines at the location of the transverse portion. The mateface gap further comprises an aligned portion that is aligned with the direction of the streamlines at the location of the aligned portion.

In accordance with additional aspects, the mateface gap at the transverse portion may comprise a stepped down elevation extending in a downstream direction of the streamlines. In a particular aspect, the endwalls between the first and second airfoils may comprise a contoured endwall region including a decreasing elevation portion extending in a direction from the first airfoil toward the second airfoil. The mateface gap may extend across the decreasing elevation portion. Alternatively or in addition, a first airfoil side one of the adjoining platforms may comprise a cooling fluid passage that communicates with the transverse portion of the mateface gap, and that may be aligned with the streamline direction to project a cooling fluid flow across the mateface gap and over the stepped down elevation of a second airfoil side one of the adjoining pair of platforms. Alternatively or in addition, a second airfoil side one of the adjoining platforms may comprise a cooling fluid passage that communicates with the transverse portion of the mateface gap, and that may be aligned to project a cooling fluid flow across the mateface to impinge upon an opposing first airfoil side of the mateface gap, and the first airfoil side of the mateface gap may be configured to redirect the impinging cooling fluid flow in the direction of the streamlines at the transverse portion.

In accordance with an additional aspect, the transverse portion of the mateface gap may be oriented generally perpendicular to the direction of the streamlines at the location of the transverse portion.

In accordance with a further aspect, the mateface gap may comprise first and second aligned portions, wherein the transverse portion is located between the first and second aligned portions. The mateface gap may further comprise at least two inflection points that are directed in opposite directions. In accordance with an alternative aspect, the mateface gap may comprise first and second transverse portion, wherein the second transverse portion is located between the second aligned portion and the downstream edge. The mateface gap may further comprise three inflection points that are directed in alternating directions and form transitions between the first and second transverse portions and the first and second aligned portions.

In accordance with another aspect of the invention, the present disclosure provides an assembly of flow directing members that may be located in an axial flow path for a working gas in a gas turbine engine. A plurality of airfoils is mounted to respective platforms. Each airfoil includes a span dimension extending radially outwardly through the flow path and a chord dimension generally extending in an axial direction of the flow path. The platforms comprise endwalls facing the flow path and defining a circumferential boundary of the flow path. The platforms comprise an adjoining pair of platforms having side edges defining matefaces adjoining each other and forming a mateface gap extending from an upstream edge of the platforms to a downstream edge of the platforms. A contoured endwall region is defined on endwalls between a first airfoil and an adjacent second airfoil and includes a decreasing elevation portion extending in a direction from the first airfoil toward the second airfoil, and the mateface gap extends across the decreasing elevation portion. The working gas defines a flow field adjacent to the endwalls and comprises streamlines extending generally transverse to the mateface gap in a direction from the first airfoil toward the second airfoil. A cooling fluid passage is provided that communicates with the mateface gap, and the cooling fluid passage is configured to provide a flow of cooling fluid into the flow path in a direction of the streamlines of the flow field adjacent to the cooling fluid passage. The mateface gap at the cooling fluid passage comprises a stepped down elevation extending in a downstream direction of the streamlines.

In accordance with further aspects of the invention, a first airfoil side one of the adjoining platforms may comprise a cooling fluid passage that communicates with the mateface gap, and which may be aligned with the streamline direction to project a cooling fluid flow across the mateface gap and over the stepped down elevation of a second airfoil side one of the adjoining pair of platforms. The second airfoil side one of the adjoining pair of platforms may be formed such that it does not include a cooling fluid passage in communication with the mateface gap in an area opposite from the cooling fluid passages in the first airfoil side one of the adjoining platforms. In an alternative aspect, a second airfoil side one of the adjoining platforms may comprise a cooling fluid passage that communicates with the mateface gap, and which is aligned to project a cooling fluid flow across the mateface to impinge upon an opposing first airfoil side of the mateface gap; the first airfoil side of the mateface gap may further be configured to redirect the impinging cooling fluid flow in the direction of the streamlines at the transverse portion. In particular, the first airfoil side of the mateface gap may be configured with an inwardly concave contour to redirect the impinging cooling fluid flow in a reverse direction in order to flow in the direction of the streamlines. In a further alternative aspect, a seal may extending between the adjacent matefaces and may include a cooling fluid passage that provides a flow of cooling fluid through the seal counteracting flow of the working gas into the mateface gap; the flow of cooling fluid through the seal may have a component in the direction of the streamlines at the location of the passages.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
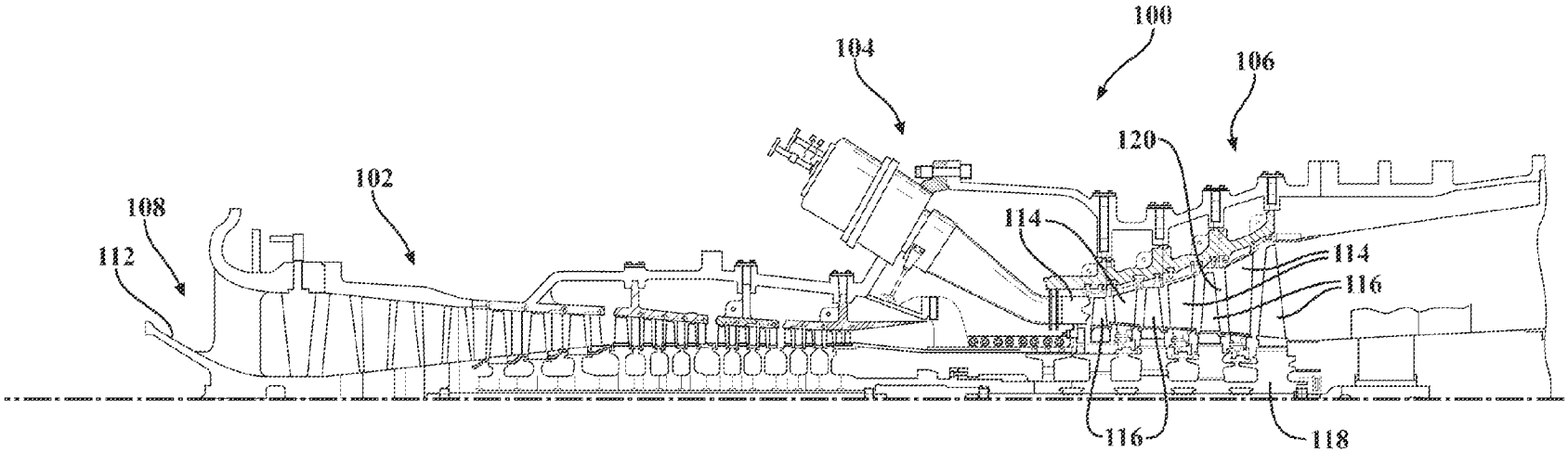
FIG. 1 is a partial cross-sectional view of a gas turbine engine incorporating an airfoil structure formed in accordance with aspects of the invention.

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

One possible way to reduce aerodynamic losses in the turbine section of a gas turbine engine is to incorporate endwall contouring on the blade and vane shrouds in the turbine section. Endwall contouring when optimized can result in a significant reduction in secondary flow vortices which can contribute to high losses in the stage. In addition, endwall contouring can also help reduce heat load into the part, which may permit a reduction in the cooling requirements of the part as well as improving part life. However, it has been observed that, even with endwall contouring, the actual turbine efficiency may be lower than an efficiency predicted for an endwall contour design. Such losses may be due to a negative impact associated with an interface or gap between adjacent components, such as adjacent blade structures or vane structures. In particular, these interfaces are manifested as mateface gaps between components which form troughs in the gas path. The main flow of a working gas passing through the turbine section can enter the mateface gaps, stagnate on one of the matefaces and then re-circulate and travel downstream in the gap. This flow stagnation and flow recirculation is believed to interfere with the beneficial effects of the endwall contour, such effects including a substantially continuous attached flow with reduced secondary vortices along the endwalls. Further, leakage flow ejected from the mateface gaps back into the flow passing over the contoured endwalls may induce additional pressure losses, further counteracting the design benefits of endwall contouring.

In accordance with an aspect of the present invention, a mateface design for airfoil structures in a gas turbine engine provides a non-linear configuration extending in an axial direction of the turbine, and may include one or more inflection points, and may be configured with either straight or curved portions. The elevation of the platforms or shrouds between two adjacent airfoil structures need not be the same or follow a smooth contour. A modified mateface gap may be configured to facilitate flow of a portion of the working gas along endwall contouring of the platforms or shrouds to mitigate pressure losses of flow. A portion of the mateface gap may be oriented generally perpendicular to a flow direction of the working gas passing over the end walls, and another portion of the mateface gap may be aligned generally parallel with the flow direction. In accordance with an aspect of the mateface design, a backward facing step type arrangement may be employed to improve aerodynamics locally. The orientation of the backward facing step is located with reference to a flow field of the working gas at the endwalls defined on the platforms or shrouds.

It should be understood that the aspects described in the following discussion may be applied equally to a vane structure or blade structure incorporated in a turbine section of a gas turbine engine, and are generally referred to herein as airfoil structures. As described herein, an airfoil structure includes a radially extending flow directing member or airfoil supported to a circumferentially and axially extending platform or shroud, hereinafter referred to as a platform, forming either an inner or outer peripheral boundary for a flow path of a hot working gas flowing axially through the turbine section.

In accordance with one aspect, the present invention may be incorporated on an endwall of a platform including contours intended to reduce formation of secondary vortices in flow passing over the endwall. Such endwall contours typically include peaks and valleys and substantially continuous inclined or ramped surfaces therebetween. In order to take advantage of this contour, a mateface gap between adjacent airfoil structures may be located such that it is downstream of a peak of the contour, as defined with reference to the flow direction of one or more streamlines in a flow field adjacent to the endwall. Locating the mateface gap downstream of a contour peak, or higher elevation area, results in a backward facing step formed by the matefaces defining the gap. Further, as is described in detail below, mateface cooling holes and gap seal leakage flows may be oriented to facilitate attached flow by counteracting formation of secondary vortices, such as by energizing the flow field passing over the endwall at the location of the mateface gap.

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

In FIG. 1 a gas turbine engine 100 is illustrated including a compressor section 102, a combustor 104, and a turbine section 106. The compressor section 102 compresses ambient air 108 that enters an inlet 112. The combustor 104 combines the compressed air with a fuel and ignites the mixture creating combustion products defining a working fluid. The working fluid travels to the turbine section 106. Within the turbine section 106 are rows of stationary vanes 114 and rows of rotating blades 116 coupled to a rotor 118, each pair of rows of vanes 114 and blades 116 forming a stage in the turbine section 106. The vanes 114 and blades 116 extend radially into an axial flow path 120 extending through the turbine section 106. The working fluid expands through the turbine section 106 and causes the blades 116, and therefore the rotor 118, to rotate. The rotor 118 extends into and through the compressor 102 and may provide power to the compressor 102 and output power to a generator (not shown).

Figure 2:
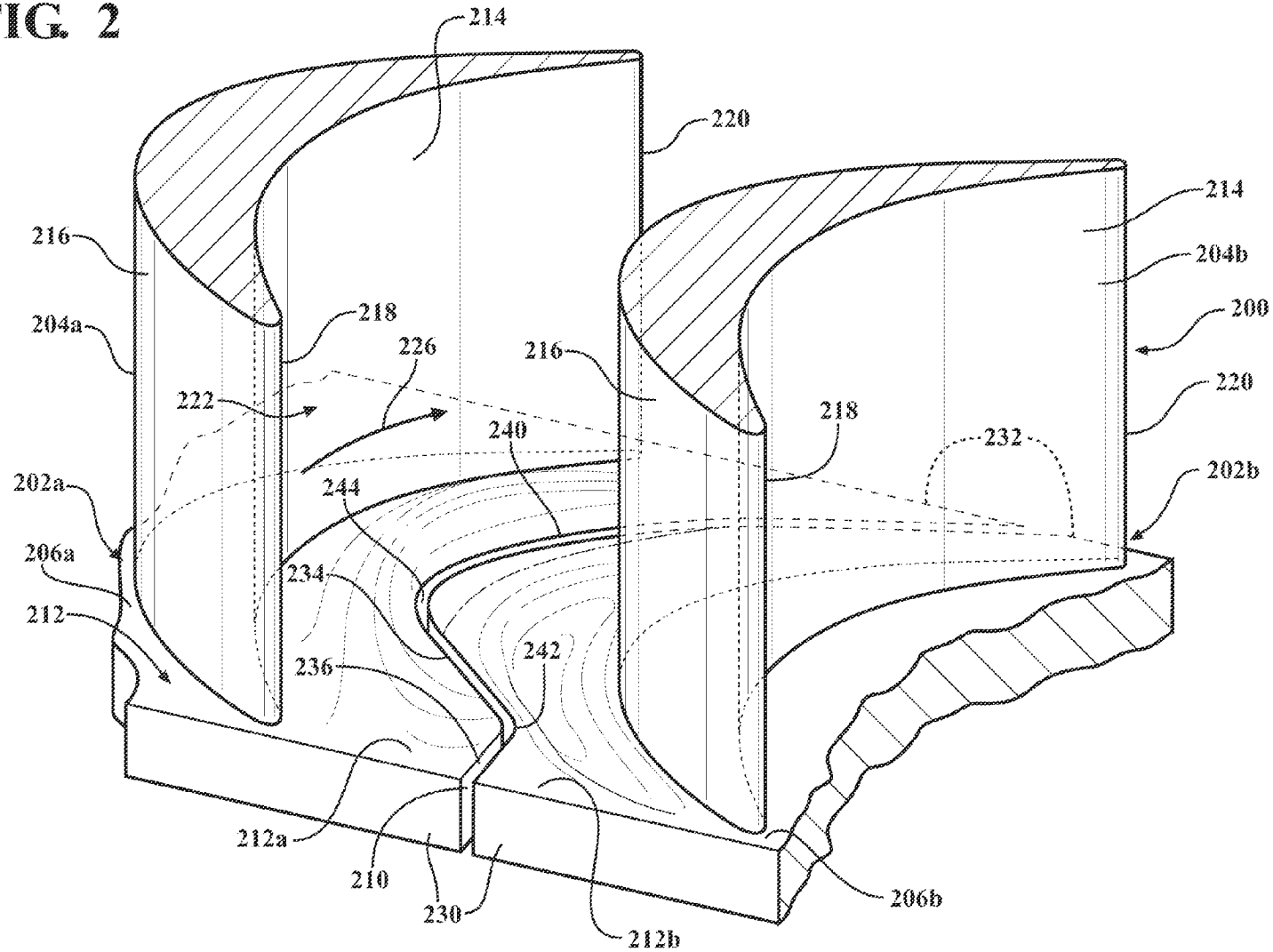
FIG. 2 is a perspective view of two airfoil structures of a turbine stage, illustrating aspects of the invention.

Referring to FIG. 2, a portion of a turbine stage 200 is depicted with two adjacent airfoil structures including a first airfoil structure 202*a* and a second airfoil structure 202*b*. The airfoil structures 202*a*, 202*b* include respective airfoils 204*a*, 204*b*, each airfoil 204*a*, 204*b* being integrally attached to a respective platform 206*a*, 206*b*. The platforms 206*a*, 206*b* define an endwall 212, formed by respective endwall portions or endwalls 212*a*, 212*b*, and adjoin one another at a mateface gap 210. The endwall 212 defines a portion of a circumferential boundary for the flowpath 120, and may comprise either a radially inner or radially outer boundary portion for the flowpath 120.

The airfoils 204*a*, 204*b* each include a generally concave pressure side 214 and a generally convex suction side 216 defined by a radially extending spanwise dimension and an axially extending chordwise dimension, the chordwise dimension extending between a leading edge 218 and a trailing edge 220. The adjacent airfoils 204*a*, 204*b* form a flow passage 222 therebetween bounded by radially inner and outer endwalls, i.e., comprising an endwall 212 at either end. During operation, the working fluid flows axially downstream through the flow passage 222 defined between the airfoil structures 202*a*, 202*b*, i.e., comprising either vanes 114 or blades 116. The airfoil structures 202*a*, 202*b* are shaped for extracting energy from the working fluid as the working fluid passes through the flow path 120.

As noted above, the adjoining pair of platforms 206*a*, 206*b* form a mateface gap 210 therebetween. In particular, referring to FIG. 3, the mateface gap 210 is formed by side edges defining opposing matefaces 228*a*, 228*b* extending from an upstream edge 230 of each of the platforms 206*a*, 206*b* to a downstream edge 232 of each of the platforms 206*a*, 206*b*. The opposing matefaces 228*a*, 228*b* extend substantially parallel to each other in the radial direction, generally perpendicular to the endwalls 212*a*, 212*b*. While a main flow 226 of working gas passes through the flow passage 222 generally in the axial direction, the working gas further defines a flow field adjacent to the endwalls 212*a*, 212*b* comprising streamlines 238, wherein at least a portion of the streamlines 238 extend generally transverse to the axial direction, i.e., extending from the first airfoil 204*a* toward the adjacent second airfoil 204*b*. The mateface gap 210 comprises a transverse portion 234 that traverses a direction of the streamlines 238 at the location of the transverse portion 234. In accordance with a particular aspect of the mateface gap 210, the transverse portion 234 may extend substantially perpendicular to streamlines 238, which are particularly identified as streamlines $\mathbf{238}_T$.

The mateface gap 210 may additionally comprise an aligned portion 236, extending from an upstream end of the transverse portion 234, and generally aligned with the direction of at least a portion of the streamlines 238, as particularly depicted by streamlines 238A, at the location of the aligned portion 236. In accordance with a further aspect of the invention, the aligned portion 236 may comprise a first aligned portion 236 extending from the upstream edge 230 to the transverse portion 234, and a second aligned portion 240 may be provided generally aligned with streamlines 238A at the location of the second aligned portion 240. The second aligned portion 240 may extend from the downstream end of the transverse portion 234 to the downstream edge 232. Hence, the mateface gap 210 may comprise a non-linear path from the upstream edge 230 to the downstream edge 232 including, in the exemplary configuration of FIG. 3, two inflection points 242 and 244 providing respective transitions from the first aligned portion 236, to the transverse portion 234, and to the second aligned portion 240. The inflection points 242, 244 may be more or less curved than is illustrated in FIG. 3 and may, for example, comprise substantially sharp angle transitions.

In accordance with a particular aspect of the mateface gap 210, the mateface gap 210 is configured to extend either substantially transverse, e.g., perpendicular, to the local streamlines 238, or extend substantially parallel to the local streamlines 238. The orientation of the mateface gap 210 with reference to the local streamlines 238 is such that stagnation of the flow field and/or formation of secondary vortices at the mateface gap 210 may be substantially reduced or minimized, thereby reducing pressure losses in the flow field.

Figure 3:
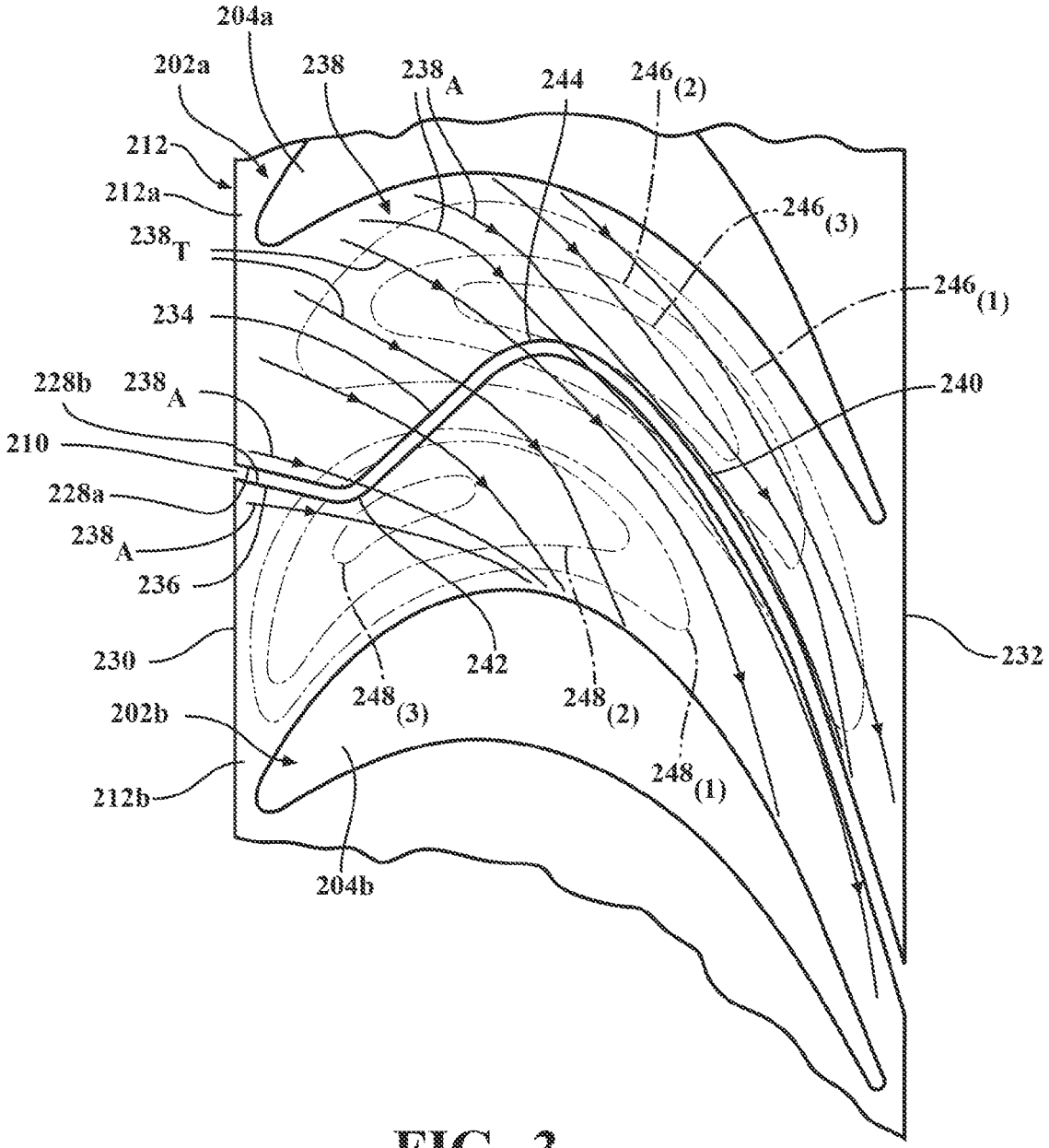
FIG. 3 is a plan view of an exemplary contoured endwall of a pair of adjoining airfoil structures and defining a mateface gap having two inflection points.

As may be seen in FIG. 3, the endwall 212 may comprise a contoured configuration continuously formed by the adjacent endwalls 212*a*, 212*b* of the adjacent airfoil structures 202*a*, 202*b*. For example, and without limitation to aspects of the present invention, a contour configuration may comprise a raised or peak area $\mathbf{246}_{(3)}$ and a recessed or valley area $\mathbf{248}_{(3)}$. The contour may continuously or smoothly decrease in elevation from the peak area $\mathbf{246}_{(3)}$, as represented by successive contour lines $\mathbf{246}_{(2)}$, $\mathbf{246}_{(1)}$ in FIG. 3; and the contour may continuously or smoothly increase in elevation from the valley area $\mathbf{248}_{(3)}$, as represented by successive contour lines $\mathbf{248}_{(2)}$, $\mathbf{248}_{(1)}$ in FIG. 3. Hence, the decreasing elevation profile of the endwall generally extends in a direction from the first airfoil 204*a* toward the second airfoil 204*b*. The contoured endwall 212 may be provided to reduce secondary flow vortices, and associated losses, in the flow field adjacent to the endwall 212.

Figure 5:
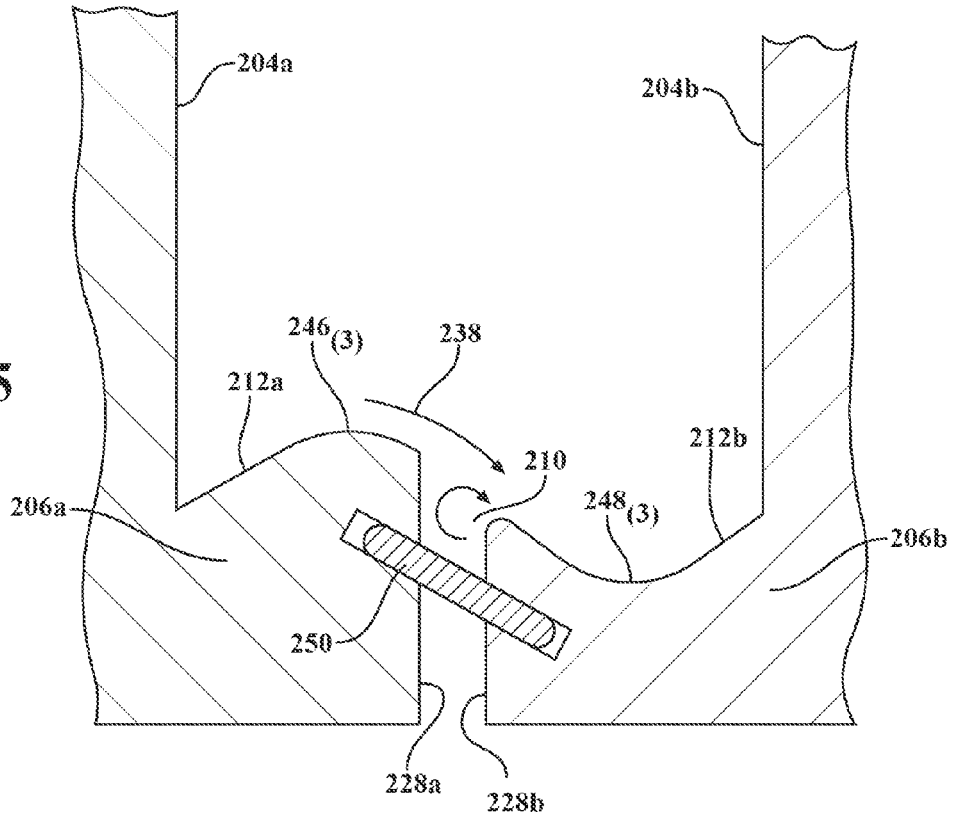
FIG. 5 is diagrammatic view in radial cross section through a transverse portion of a mateface gap with a step down elevation.

The configuration of the mateface gap 210, i.e., with a transverse portion 234 and aligned portions 236, 240, may operate to avoid flows that could offset the advantages provided to the flow field by the contoured configuration. In particular, as described above, the mateface gap 210 is configured to substantially reduce or minimize stagnation of the flow and/or formation of secondary vortices at locations where the flow field passes over the mateface gap 210. Further, the transverse portion 234 of the mateface gap 210 is positioned and oriented at locations where the elevation decreases in the direction of flow of the streamlines, e.g., streamlines $238_T$. Such an orientation for the transverse portion 234 creates a backward facing step, i.e., decreasing elevation, from the mateface 228*a* to the mateface 228*b*, as is illustrated, for example, in FIG. 5, facilitating flow from the endwall 212*a* across the mateface gap 210 to the endwall 212*b* without a substantial or sufficient portion of the flow entering or remaining in the mateface gap 210, i.e., without a substantial portion stagnating at the mateface 228*b*, or creating secondary vortices at the endwall 212, or otherwise substantially interacting with the matefaces 228*a*, 228*b*. FIG. 5 further illustrates a mateface seal 250 that may be configured to minimize or reduce entry of the working gas into the mateface gap 210. For example, the mateface seal 250 may be radially angled in the circumferential direction, generally following an associated contour of the enwall 212, to reduce an area of the mateface gap 210 above the mateface seal 250.

It should be understood that, although the transverse portion 234 is illustrated as a straight portion extending between the inflection points 242 and 244, the transverse portion 234 may be configured with a curvature to orient the transverse portion 234 substantially perpendicular to the local streamlines $238_T$ and/or to form a step of decreasing elevation in the direction of the streamline flow along the length of the transverse portion 234.

Figure 4:
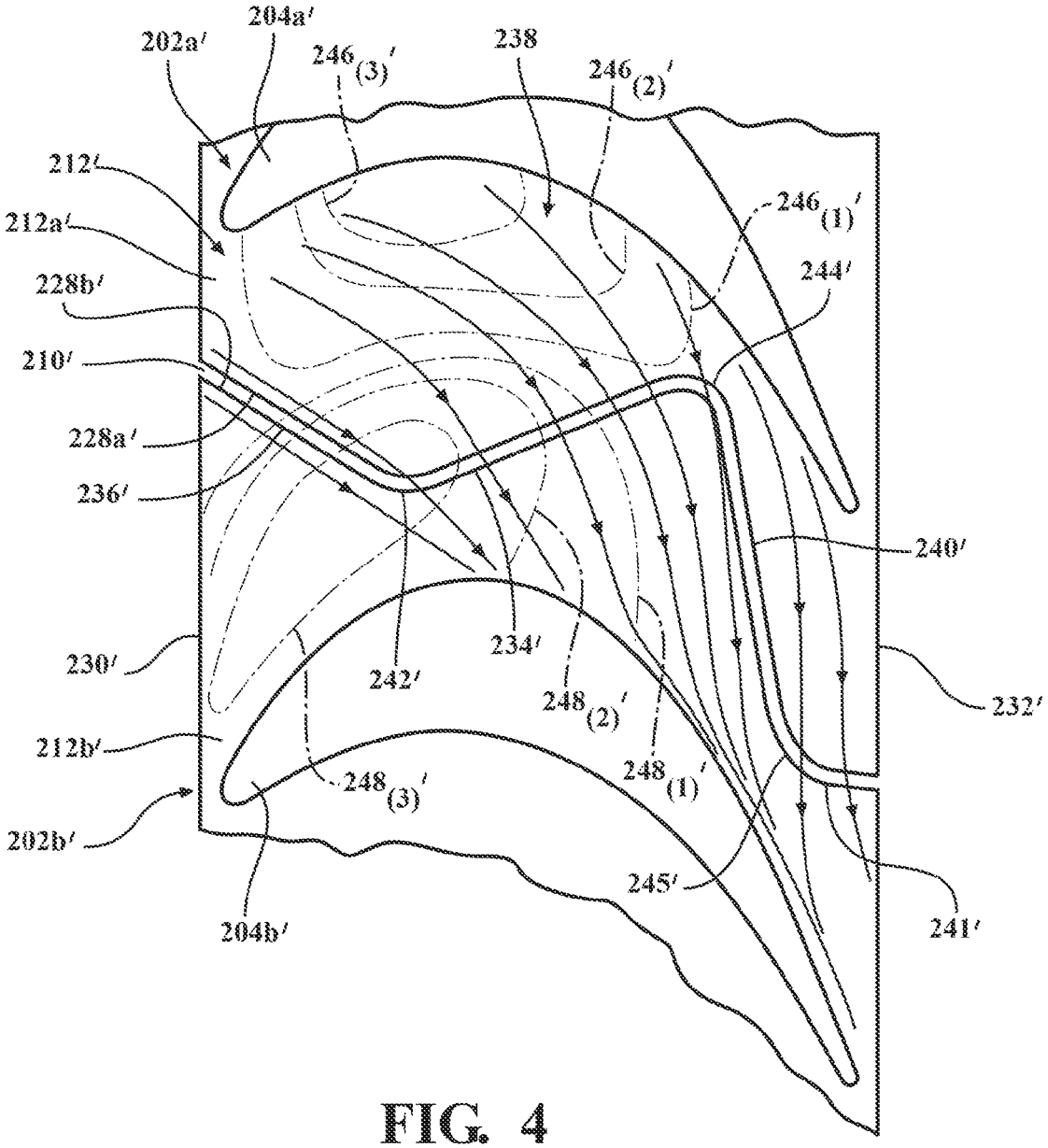
FIG. 4 is a plan view of another exemplary contoured endwall of a pair of adjoining airfoil structures and defining a mateface gap having three inflection points.

Referring to FIG. 4, an alternative configuration of the mateface gap is illustrated in accordance with a further aspect of the invention, wherein elements corresponding to similar elements in FIG. 3 are identified with the same reference numeral primed.

FIG. 4 illustrates a mateface gap 210' formed between the platforms 206*a*', 206*b*' of adjacent first and second airfoil structures 202*a*', 202*b*'. The mateface gap 210' may comprise a first aligned portion 236' extending from the upstream edge 230', and a second aligned portion 240' separated from the first aligned portion 236' by a first transverse portion 234'. A second transverse portion 241' extends between the second aligned portion 240' and the downstream edge 232'. The first and second aligned portions 236', 240' are generally aligned with the direction of the streamlines 238A, and the first and second transverse portions 234', 241' traverse a direction of the streamlines $238_T'$, and may extend substantially perpendicular to the streamlines $238_T'$ at the location of the transverse portions 234', 241'. Hence, the mateface gap 210' may comprise a non-linear path from the upstream edge 230' to the downstream edge 232' including, in the exemplary embodiment of FIG. 4, three alternately directed inflection points 242', 244', 245'. The inflection points 242', 244', 245' may be more or less curved than is illustrated in FIG. 4 and may, for example, comprise substantially sharp angle transitions.

The mateface gap 210' is configured to extend either substantially transverse, e.g., perpendicular, to the local streamlines 238', or extend substantially parallel to the local streamlines 238'. The orientation of the mateface gap 210' with reference to the local streamlines 238' is such that stagnation of the flow field and/or formation of secondary vortices at the mateface gap 210' may be substantially reduced or minimized, thereby reducing pressure losses in the flow field.

As may be seen in FIG. 4, the endwall 212' may comprise a contoured configuration continuously formed by the adjacent endwalls 212*a*', 212*b*' of the adjacent airfoil structures 202*a*', 202*b*'. For example, and without limitation to aspects of the present invention, a contour configuration may comprise a raised or peak area $246_{(3)}'$ and a recessed or valley area $248_{(3)}'$. The contour may continuously or smoothly decrease in elevation from the peak area $246_{(3)}'$, as represented by successive contour lines $246_{(2)}'$, $246_{(1)}'$ in FIG. 4; and the contour may continuously or smoothly increase in elevation from the valley area $248_{(3)}'$, as represented by successive contour lines $248_{(2)}'$, $248_{(1)}'$ in FIG. 4. Hence, the decreasing elevation profile of the endwall generally extends in a direction from the first airfoil 204*a*' toward the second airfoil 204*b*'. The contoured endwall 212' may be provided to reduce secondary flow vortices, and associated losses, in the flow field adjacent to the endwall 212'. As illustrated in FIG. 4, the transverse portion 234' of the mateface gap 210' may extend generally perpendicular to the contour lines $248_{(3)}'$, $248_{(2)}'$, $248_{(1)}'$, oriented substantially perpendicular to the streamlines 238' flowing along the endwall contour, as depicted be the contour lines $248_{(3)}'$, $248_{(2)}'$, $248_{(1)}'$. Further, it should be understood that the endwall 212*b*' at the mateface 228*b*' may be formed to have a lower elevation than the endwall 212*a*' at an adjacent mateface 228*a*' to provide a backward step, as described above with reference to FIG. 5.

It should be noted that the configurations for the mateface gaps 210, 210' provide an interface or junction between the adjacent platforms 206*a*, 206*b* or 206*a*', 206*b*' where the flow along the streamlines 238, 238' may remain substantially attached to the endwall 212, 212' as it passes either substantially perpendicular or substantially parallel to the mateface gap 210, 210', reducing or minimizing disturbance of the mateface gap 210, 210' to the flow at the endwall 212, 212'. Further, the inflection points provided between the described aligned and transverse portions substantially limits recirculating flow from forming along the length of the mateface gaps 210, 210' and re-entering the flow field passing along the endwall 212, 212', which recirculating flow could otherwise produce vortical flow structures in the flow field.

Figure 6:
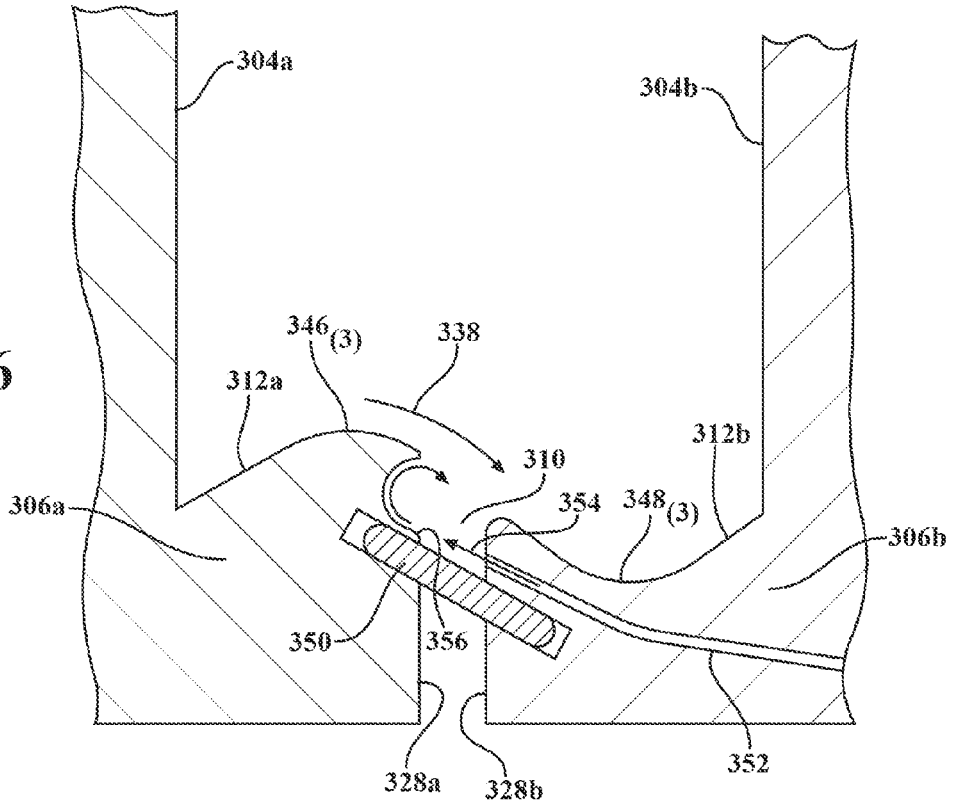
FIG. 6 is a diagrammatic view similar to FIG. 5, illustrating a first alternative aspect including an injection of a cooling fluid from a downstream mateface to impinge on an upstream mateface.
Figure 7:
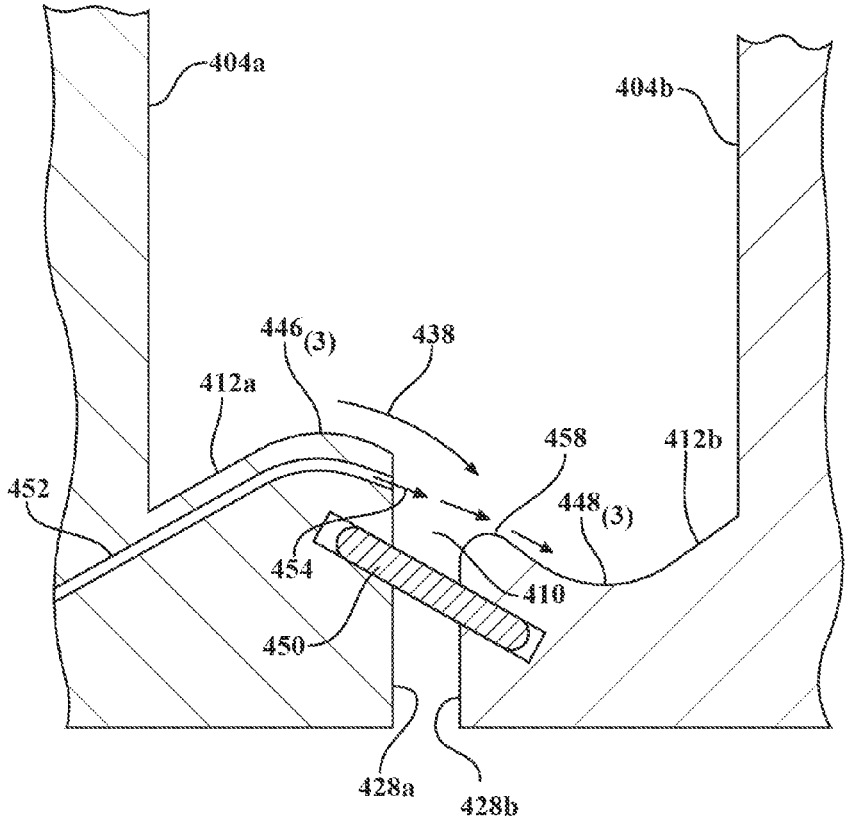
FIG. 7 is a diagrammatic view similar to FIG. 5, illustrating a second alternative aspect including injection of a cooling fluid from a mateface in the direction of streamlines flowing across the endwall.
Figure 8:
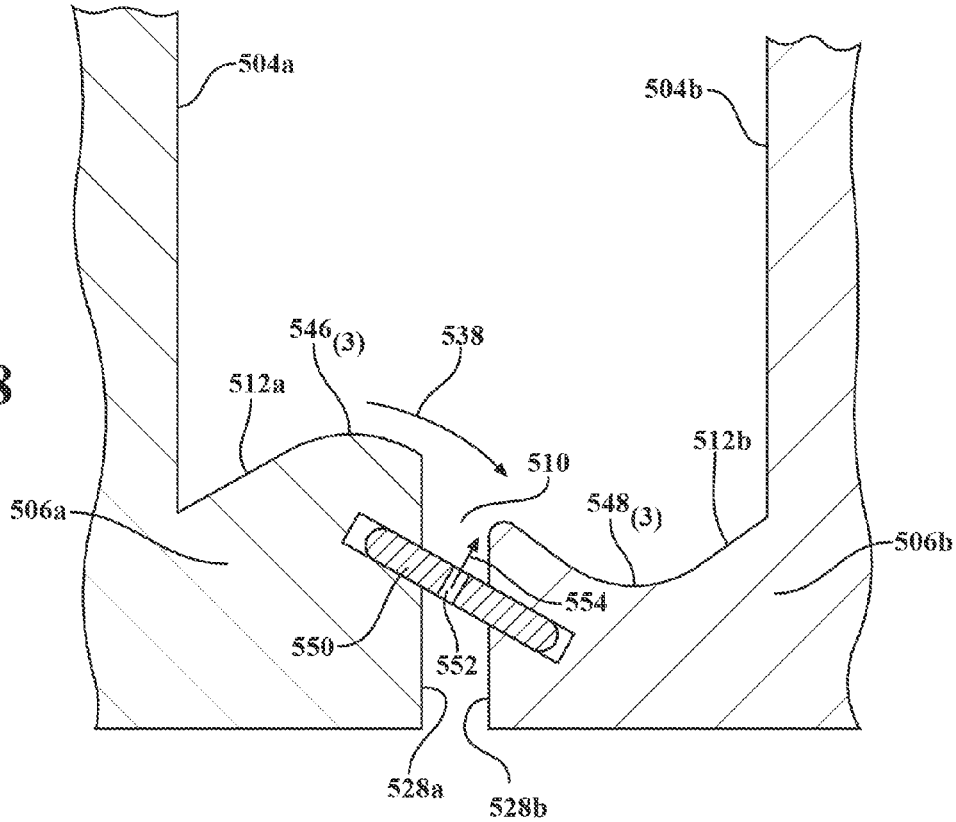
FIG. 8 is a diagrammatic view similar to FIG. 5, illustrating a third alternative aspect including injection of a cooling fluid into the mateface gap through a passage formed in a mateface seal.

FIGS. 6-8 describe additional aspects of the invention, as modifications of the structure illustrated in FIG. 5, which may advantageously incorporate the mateface gap 210 to facilitate maintaining a substantially attached flow through the use of a cooling fluid flow injected to the flow at the mateface gap 210. In particular, it may be understood that flow along the contoured endwall 212 may not remain attached along the entire path of flow between the airfoils 204*a*, 204*b*, which may result in formation of secondary vortices with associated pressure losses. In accordance with the aspects illustrated in FIGS. 6-8, such undesirable losses may be mitigated at the mateface gap 210.

Referring to FIG. 6, elements corresponding to similar elements in FIG. 5 are identified with the same reference numeral increased by 100. In the configuration of FIG. 6, one or more cooling fluid passages 352 may be provided for discharging a cooling fluid 354 from the downstream mateface 328*b* toward the upstream mateface 328*a*. The cooling fluid 354 may be provided from a cooling fluid channel (not shown) extending through the airfoil 304*b*, or may be provided from any other location or source of cooling fluid that may be associated with platform 306*b*. The mateface 328*a* may be configured to redirect the impinging cooling fluid 354 from the opposing mateface 328*b*, and may be configured with an inwardly concave contour 356, to redirect the cooling fluid 354 in a reverse direction to flow in the direction of the streamlines 338. In addition to cooling the mateface 328*a*, the redirected cooling fluid 354 may provide a substantially attached flow by energizing the flow field to counteract formation of secondary vortices in the flow as it passes over the mateface gap 310. The one or more passages 352 may be aligned or oriented, both radially and axially, to direct the cooling fluid 354 to enter the flow field substantially parallel to the streamlines 338.

Referring to FIG. 7, elements corresponding to similar elements in FIG. 5 are identified with the same reference numeral increased by 200. In the configuration of FIG. 7, one or more cooling fluid passages 452 may be provided for discharging a cooling fluid 454 from the upstream mateface 428*a* toward the downstream mateface 428*b*. The cooling fluid 454 may be provided from a cooling fluid channel (not shown) extending through the airfoil 404*a*, or may be provided from any other location or source of cooling fluid that may be associated with platform 406*a*. The platform 406*b* may be provided with a reduced elevation contour at a corner 458 of the mateface 428*b* opposite the one or more passages 452, such that a flow of cooling fluid discharged from the one or more passages 452 may pass across to the surface of the endwall 412*b*. A portion of the cooling fluid 454 may enter the mateface gap 410 and may impinge on and cool the mateface 428*b*. The flow of cooling fluid 454 may enter the flow of the working gas to energize the flow of working gas passing across the mateface gap 410, and thereby maintain a substantially attached flow field at the mateface gap 410. The one or more passages 452 may be aligned or oriented, both radially and axially, to direct the cooling fluid 454 to enter the flow field substantially parallel to the streamlines 438.

Referring to FIG. 8, elements corresponding to similar elements in FIG. 5 are identified with the same reference numeral increased by 300. In the configuration of FIG. 8, one or more cooling passages 552 may be provided through the mateface seal 550 for discharging a cooling fluid 554 into the mateface gap 510. The cooling fluid may be provided from a cooling fluid plenum, such as may be provided on an interior side of the platforms 506*a*, 506*b* to provide a pressurized area for preventing passage of the working gas through the seal 550. The flow of cooling fluid 554 into the mateface gap 510 may operate to counteract entry of the working gas into the mateface gap 510, thereby facilitating an attached flow of the working gas as it passes downstream of the mateface gap 510 to the endwall 512*b*. Further, the one or more passages 552 may be aligned or oriented such that the cooling fluid is discharged having a component in the direction of the streamlines 538 at the mateface gap 510. That is, the one or more passages 552 may be angled downstream such that the cooling fluid 554 may provide a cooling fluid flow in the downstream direction to energize the flow of working gas passing across the mateface gap 510, and thereby maintain attached flow of the flow field as it passes downstream of the mateface gap 510 to the endwall 512*b*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a turbine engine defining an axial flow path for a working gas, an assembly of flow directing members comprising:

a plurality of airfoils mounted to respective platforms, each airfoil including a span dimension extending radially outwardly through the flow path and a chord dimension generally extending in an axial direction of the flow path, and the platforms comprising endwalls facing the flow path and defining a circumferential boundary of the flow path;

the platforms comprising an adjoining pair of platforms having side edges defining matefaces adjoining each other and forming a mateface gap extending from an upstream edge of the platforms to a downstream edge of the platforms, wherein the mateface gap comprises a non-linear path;

the working gas defining a flow field adjacent to the endwalls comprising streamlines extending generally transverse to the axial direction from a concave pressure side of a first airfoil toward an adjacent second airfoil; and the mateface gap comprising a transverse portion that traverses a direction of the streamlines generally perpendicular to the streamlines at the location of the transverse portion, and the mateface gap comprising an aligned portion extending from a curved or angled transition point between an upstream end of the transverse portion and the aligned portion that wherein the aligned portion is aligned generally parallel with the direction of the streamlines at the location of the aligned portion.

2. The assembly of claim 1, wherein the mateface gap at the transverse portion comprises a stepped down elevation extending in a downstream direction of the streamlines.

3. The assembly of claim 2, wherein the endwalls between the first and second airfoils comprise a contoured endwall region including a decreasing elevation portion extending in a direction from the first airfoil toward the second airfoil, and the mateface gap extending across the decreasing elevation portion.

4. The assembly of claim 2, wherein a first adjoining platform comprises an upstream mateface, the upstream mateface comprising a cooling fluid passage that communicates with the transverse portion of the mateface gap and is aligned with the streamline direction at the transverse portion to project a cooling fluid flow across the mateface gap and over the stepped down elevation of a second adjoining platform.

5. The assembly of claim 2, wherein the adjoining platforms comprise a first adjoining platform and a second adjoining platform, the first adjoining platform further comprising an upstream mateface and the second adjoining platform further comprising a downstream mateface, wherein the downstream mateface comprises a cooling fluid passage that communicates with the transverse portion of the mateface gap and is aligned to project a cooling fluid flow across the mateface gap to impinge upon the upstream mateface of the first adjoining platform to generate an impinging cooling fluid flow, the upstream mateface being configured to redirect the impinging cooling fluid flow in the direction of the streamlines at the transverse portion.

6. The assembly of claim 1, wherein the aligned portion comprises a first aligned portion, the mateface gap further comprising a second aligned portion aligned generally parallel with the direction of the streamlines at the location of the second aligned portion, wherein the transverse portion is located between the first and second aligned portions.

7. The assembly of claim 6, wherein the first aligned portion extends from a location adjacent the upstream edge to the transverse portion, and the second aligned portion extends from the transverse portion to a location adjacent the downstream edge.

8. The assembly of claim 7, wherein the mateface gap comprises at least two inflection points that are directed in opposite directions.

9. The assembly of claim 6, wherein the transverse portion comprises a first transverse portion, the mateface gap further comprising a second transverse portion, wherein the second transverse portion is located between the second aligned portion and the downstream edge.

10. The assembly of claim 9, wherein the mateface gap comprises three inflection points that are directed in alternating directions and form transitions between the first and second transverse portions and the first and second aligned portions.

11. The assembly of claim 1, further comprising a seal extending between the adjoining matefaces, the seal including a feature counteracting flow of the working gas into the mateface gap.

12. The assembly of claim 11, wherein the feature counteracting flow of the working gas into the mateface gap includes a cooling fluid passage that provides a flow of cooling fluid through the seal and discharged into the mateface gap, the flow of cooling fluid through the seal having a component in the direction of the streamlines at the location of the passages.

13. In a gas turbine engine defining an axial flow path for a working gas, an assembly of flow directing members comprising:

a plurality of airfoils mounted to respective platforms, each airfoil including a span dimension extending radially outwardly through the flow path and a chord dimension generally extending in an axial direction of the flow path, and the platforms comprising endwalls facing the flow path and defining a circumferential boundary of the flow path;

the platforms comprising an adjoining pair of platforms having side edges defining matefaces adjoining each other and forming a mateface gap extending from an upstream edge of the platforms to a downstream edge of the platforms, wherein the mateface gap comprises a non-linear path;

a contoured endwall region defined on endwalls between a first airfoil and an adjacent second airfoil and including a decreasing elevation portion extending in a direction from the first airfoil toward the second airfoil, and the mateface gap extending across the decreasing elevation portion;

the working gas defining a flow field adjacent to the endwalls comprising streamlines extending generally transverse to the mateface gap in a direction from the first airfoil toward the second airfoil;

a cooling fluid passage that communicates with the mateface gap and configured to provide a flow of cooling fluid into the flow path in a direction of the streamlines of the flow field adjacent to the cooling fluid passage; and the mateface gap at the cooling fluid passage comprises a stepped down elevation extending in a downstream direction of the streamlines, wherein the mateface gap comprises a transverse portion that extends generally perpendicular to a direction of the streamlines at the location of the transverse portion, the mateface gap comprising an aligned portion that is aligned generally parallel with the direction of the streamlines at the location of the aligned portion, and the cooling passage discharging at a location along the transverse portion.

14. The assembly of claim 13, wherein a first adjoining platform comprises an upstream mateface, the upstream mateface comprising the cooling fluid passage that communicates with the mateface gap and is aligned with the streamline direction to project a cooling fluid flow across the mateface gap and over the stepped down elevation of a second adjoining platform.

15. The assembly of claim 14, wherein the second adjoining platform does not include a cooling fluid passage in communication with the mateface gap in an area opposite from the cooling fluid passage in the first adjoining platform.

16. The assembly of claim 13, wherein the adjoining platforms comprise a first adjoining platform and a second adjoining platform, the first adjoining platform further comprising an upstream mateface and the second adjoining platform further comprising a downstream mateface, wherein the downstream mateface comprises the cooling fluid passage that communicates with the mateface gap and is aligned to project a cooling fluid flow across the mateface gap to impinge upon the upstream mateface of the first adjoining platform to generate an impinging cooling fluid flow, the upstream mateface being configured to redirect the impinging cooling fluid flow in the direction of the streamlines.

17. The assembly of claim 16, wherein the upstream mateface is further configured with an inwardly concave contour to redirect the impinging cooling fluid flow in a reverse direction in order to flow in the direction of the streamlines.

18. The assembly of claim 13, including a seal extending between the adjacent matefaces, the seal including a cooling fluid passage that provides a flow of cooling fluid through the seal and discharged into the mateface gap counteracting flow of the working gas into the mateface gap, the flow of cooling fluid through the seal having a component in the direction of the streamlines at the location of the passage.

* * * * *